US009017142B2

(12) United States Patent
van Kleef et al.

(10) Patent No.: US 9,017,142 B2
(45) Date of Patent: Apr. 28, 2015

(54) MASS FINISHING APPARATUS AND METHOD

(71) Applicants: Ericus Andreas van Kleef, Simpsonville, KY (US); Malcolm Southorn, Osprey, FL (US)

(72) Inventors: Ericus Andreas van Kleef, Simpsonville, KY (US); Malcolm Southorn, Osprey, FL (US)

( * ) Notice: Subject to any disclaimer, the term of this patent is extended or adjusted under 35 U.S.C. 154(b) by 127 days.

(21) Appl. No.: 13/767,268

(22) Filed: Feb. 14, 2013

(65) Prior Publication Data

US 2014/0227944 A1 Aug. 14, 2014

(51) Int. Cl.

| | |
|---|---|
| ***B24B 31/06*** | (2006.01) |
| ***B24B 31/00*** | (2006.01) |
| ***B24B 1/00*** | (2006.01) |

(52) U.S. Cl.

CPC ..... *B24B 31/003* (2013.01); *B24B 1/00* (2013.01)

(58) Field of Classification Search

CPC ..... B24B 31/06; B24B 31/073; B24B 31/00; B24B 31/14; B24B 31/062; B24B 31/12; B24B 31/108

USPC ..... 451/32, 36, 85, 326–330

See application file for complete search history.

(56) References Cited

U.S. PATENT DOCUMENTS

| | | | | |
|---|---|---|---|---|
| 3,380,195 | A * | 4/1968 | Bodine, Jr. | 451/113 |
| 3,623,278 | A * | 11/1971 | Schwartz | 451/32 |
| 4,173,851 | A * | 11/1979 | Higashi | 451/36 |
| 4,209,947 | A * | 7/1980 | Ohno | 451/113 |
| 4,958,776 | A * | 9/1990 | Walther | 241/171 |
| 5,251,409 | A * | 10/1993 | Orbank | 451/37 |
| 5,476,415 | A * | 12/1995 | Nishimura et al. | 451/326 |
| 5,989,109 | A * | 11/1999 | Kobayashi et al. | 451/326 |
| 6,261,154 | B1 | 7/2001 | McEneny | |
| 6,280,303 | B1 | 8/2001 | Kawasaki | |
| 6,406,356 | B1 * | 6/2002 | Brooks | 451/36 |
| 6,688,953 | B2 | 2/2004 | Kawasaki et al. | |
| 6,764,384 | B1 * | 7/2004 | Kleer et al. | 451/32 |
| 6,910,954 | B2 * | 6/2005 | Kim et al. | 451/60 |
| 6,960,116 | B2 | 11/2005 | McNeil et al. | |
| 7,048,613 | B2 | 5/2006 | Rudiger | |
| 2002/0028630 | A1 * | 3/2002 | Kobayashi et al. | 451/32 |
| 2003/0216110 | A1 * | 11/2003 | Bohm | 451/36 |
| 2004/0242134 | A1 | 12/2004 | Lee | |
| 2005/0186889 | A1 * | 8/2005 | McNeil et al. | 451/36 |
| 2006/0246825 | A1 * | 11/2006 | Bolz et al. | 451/36 |

(Continued)

FOREIGN PATENT DOCUMENTS

| | | |
|---|---|---|
| EP | 0 922 530 A2 | 6/1999 |

*Primary Examiner* — George Nguyen

(74) *Attorney, Agent, or Firm* — Wood, Herron & Evans, LLP

(57) ABSTRACT

A finishing apparatus and method for surface finishing workpieces. A tub is rotatable about vertical axis and operable to hold and rotate abrasive media completely submerged in water or other liquid. One or more manipulators, each supporting a spindle operable for supporting and rotating a workpiece about a spindle axis of the spindle with the workpiece at least partially submerged in the abrasive media and operable for holding spindle axis normal to and spaced apart from the vertical axis with the spindle horizontal in the tub during the surface finishing process while the tub is rotating. Manipulators are independently operable to present one of the workpieces for loading and unloading on and off spindle while tub is rotating and continuing to process the other workpieces submerged in the media and water. A rake includes a plate and means for lifting the plate up and down vertically through the abrasive media.

32 Claims, 4 Drawing Sheets

(56) References Cited

U.S. PATENT DOCUMENTS

2007/0238397 A1* 10/2007 Dyer ..... 451/36
2010/0136887 A1* 6/2010 Tzeng ..... 451/36
2012/0266426 A1* 10/2012 Feldmann et al. ..... 29/90.01

* cited by examiner

MASS FINISHING APPARATUS AND METHOD

BACKGROUND OF THE INVENTION

1. Field of the Invention

The present invention relates generally to mass finishing methods and machines used to process and to remove material from surfaces of workpieces such as surface finishing of metal workpieces to produce either a surface ready for further treatment (e.g., plating or coating) or a finished article.

2. Description of Related Art

Mass finishing is an industrial process used in various forms to remove material such as, but not limited to, metal from the surface of workpieces. The material is removed by physically contacting the objects with a collection of solid abrasive particles with or without the use of additional chemicals to enhance the process. Mass finishing is used in various forms to smooth-out and to reduce the surface roughness of workpieces. Mass finishing processes are used for finishing the surfaces of objects, particularly, metal workpieces, by physically contacting the objects with a collection of solid particles with or without the use of additional chemicals to enhance the process. Mass finishing machines and methods usually incorporate a motor-driven vibrating container that holds a specialized media along with appropriate chemicals or water that enhance the finishing capability and action of the media.

Mass finishing is used to reduce or eliminate the amount of hand finishing that must be applied to metal articles including articles that are processed for functionality, for example, airplane propellers which are subsequently painted. More examples of such articles include, articles that are to be further plated, for example, with chromium plating such as is commonly used in open-style alloy wheels. Cast wheels have a coarse surface that requires appropriate treatment either to give a final appearance or to prepare the surface for further plating or coating processes. These wheels tend to be difficult to completely finish in conventional media finishing machines before they are suitable either for sale as finished or after plating, painting, or other coating.

Drag finishing has been used for mass finishing. However, the workpieces being processed tend to leave the equivalent of a wake behind them as they are dragged through the media, typically, in a revolving circular pattern. The skewed pattern of the media in the wake keeps the media from presenting itself to the full face of the object being polished (or vice versa) thus, either reducing the quality of the finished part or greatly extending the time required to carry out the finish, or both. It also causes much more power to be used.

Chrome-plated wheels formed of aluminum or alloys are typically difficult to finish because of the openings ("windows") in the wheels which often require much hand finishing. If the wheels are intended to be chrome plated, they tend to take the plating less favorably in the "low current density" area of the wheel. As a result, the chrome plating process can magnify, rather than reduce, the coarse or rough appearance in those areas.

Coarse surfaces require appropriate treatment either to give a final appearance or to prepare the surface for further plating or coating processes. These wheels tend to be difficult to completely finish in conventional media finishing machines, however, usually require several steps of hand polishing and buffing, both before and after any media finishing before they are suitable either for sale as finished or after plating, painting, or other coating. This is labor intensive, time consuming, and expensive.

During finishing, the media wears down with use, the abrasive particles of the media become smaller and smaller until it is just abrasive dust. With wear, pounds of media are lost and make-up must be added. Over time, some of the media is virtually new and as supplied in size, some is just about to be completely consumed, resulting in a steady-state condition where the abrasive media is present in any size.

A typical drag finisher uses a large horsepower drive (typically in a range of 50-100 Hp) for tub rotation and a secondary smaller horsepower drive(s) (a few Hp per station) for customer part rotation about a spindle axis. The media is subject to a water/soap mist of water and spent abrasive media. In order to keep the spent media from fouling the system between processing cycles, the vessel is stopped and vibrated by means of an internally mounted eccentric rotation mass to roll the media in the vessel to counter the natural stratification, and to help drain the resulting slurry from the floor of the vessel through grated openings.

When finishing workpieces in a typical drag finisher, tub rotation drives the media to dam-up in front of the workpiece. This is the primary source of resistance to tub or vessel rotation and, in turn, the primary cause of inefficiency of the current and typical processes. This resistance results from the pressure created when the abrasive media does not flow over and through the workpiece. The media locks and balls up on itself and is pushed around in a circle consuming lots of energy not applied to finishing the workpiece, but wearing against itself and doing little work to the workpiece or the customer's part. The process exhibits a pressure bias towards the surfaces deeper down into the media. Rotation about the spindle axis presents all surfaces on the workpiece equally to the biased media pressure.

As a result of the balling-up, little media finds its way past the workpiece and through the openings in the workpiece and, as a result, the process has a slow gain in improvement of the surface roughness per unit of run time. This is not very economical and reduces throughput. Secondly, the outer edges of the workpiece are cut disproportional and the workpiece loses definition and is cut undersized, while some of the interior faces are not cut enough. Vessel or tub rotation about its axis is such that a tangential media velocity is in the 300-400 feet per minute, measured at the imaginary circle through the center of the workpiece. Workpiece rotation about the spindle axis is in the 5 to 20 rpm range.

If the mass finishing process fails to remove sufficient material or otherwise fails to properly polish the surface, the workpiece generally must be hand finished with small finishing tools. The hand finishing process tends to be labor intensive, relatively slow, and generally expensive. Additionally, the hand finishing will discharge unwanted metals into the ambient surroundings.

Accordingly, a need exists for a mass finishing technique that can successfully and completely finish all of the custom and difficult-shaped portions of certain object such as automobile wheels and do so in a manner that either successfully supports later plating or coating, or that produces a finished workpiece that has little or no need of hand finishing (or of other mechanical finishing such as relatively expensive robotic belting or buffing machines) prior to marketing and use.

SUMMARY OF THE INVENTION

A finishing apparatus for surface finishing one or more workpieces includes a tub rotatable about a vertical axis and operable to hold and rotate abrasive media completely submerged in water or other liquid. Each of one or more manipulators supports a spindle operable for supporting and rotating a workpiece about a spindle axis of the spindle with the workpiece at least partially submerged in the abrasive media. Each of the manipulators is operable for holding the spindle axis normal to and spaced apart from the vertical axis and the spindle axis substantially horizontal in the tub during the surface finishing process while the tub is rotating.

The finishing apparatus may further include a rake including a plate and means for lifting the plate up and down vertically through the abrasive media and parallel to the vertical axis. One or more drains may be located at a high water mark in the tub above the media and down tubes may extend from the drains downward to a stationary collection channel.

Each of the manipulators is operable to present the workpieces for loading and unloading the workpieces on and off the spindle while the tub is rotating.

The finishing apparatus including two or more of the manipulators and each manipulator is operable to present the workpieces for loading and unloading the workpieces on and off the spindle while the tub is rotating and each manipulator is independently operable to present one of the workpieces for loading and unloading on and off the spindle while the tub is rotating and continuing to process the other workpieces submerged in the media and water.

The finishing apparatus is operable for supplying tub power for rotating the tub during the surface finishing process, operable for supplying workpiece power, the power used to rotate a single workpiece, for rotating each one of the one or more spindles during the surface finishing process, and operable for supplying the tub power and the workpiece power, for each individual workpiece, at a ratio of tub power to workpiece power significantly less than 1:1. The ratio of tub power to workpiece power being in a range of 1:2-1:8.

A method for finishing one or more workpieces, the method includes rotating a tub containing abrasive media completely submerged in water or other liquid about a vertical axis of rotation, mounting the one or more workpieces on one or more corresponding spindles having spindle axes, at least partially submerging the one or more workpieces in the abrasive media, rotating the one or more workpieces about the spindle axes of the corresponding spindles with the spindle axes substantially and normal to and spaced apart from the vertical axis, and rotating the one or more the spindles horizontally in the tub during the surface finishing while the tub is rotating.

The method may further include rolling and mixing the abrasive media in the tub during the surface finishing while the tub is rotating. The rolling and mixing may include lifting a plate of a rake up and down vertically through the abrasive media and parallel to the vertical axis while the tub is rotating and the one or more workpieces are rotating about the spindle axes of the corresponding spindles at least partially submerged in the abrasive media.

The method may include sequentially processing or finishing a plurality of the workpieces by loading, finishing in the media and water in the tub, and then unloading each one of the workpieces while other of the workpieces are being finished in the tub. The method may include draining spent media mixture through one or more drains located at a high water mark in the tub above the media, the spent media mixture including spent media resulting from media wear during the finishing in suspension in water, and replacing the water and spent media in the drained away spent media mixture.

The method may include supplying the tub power and the workpiece power at a ratio of tub power to workpiece power significantly less than 1:1 or more particularly in a range of 1:2-1:8.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
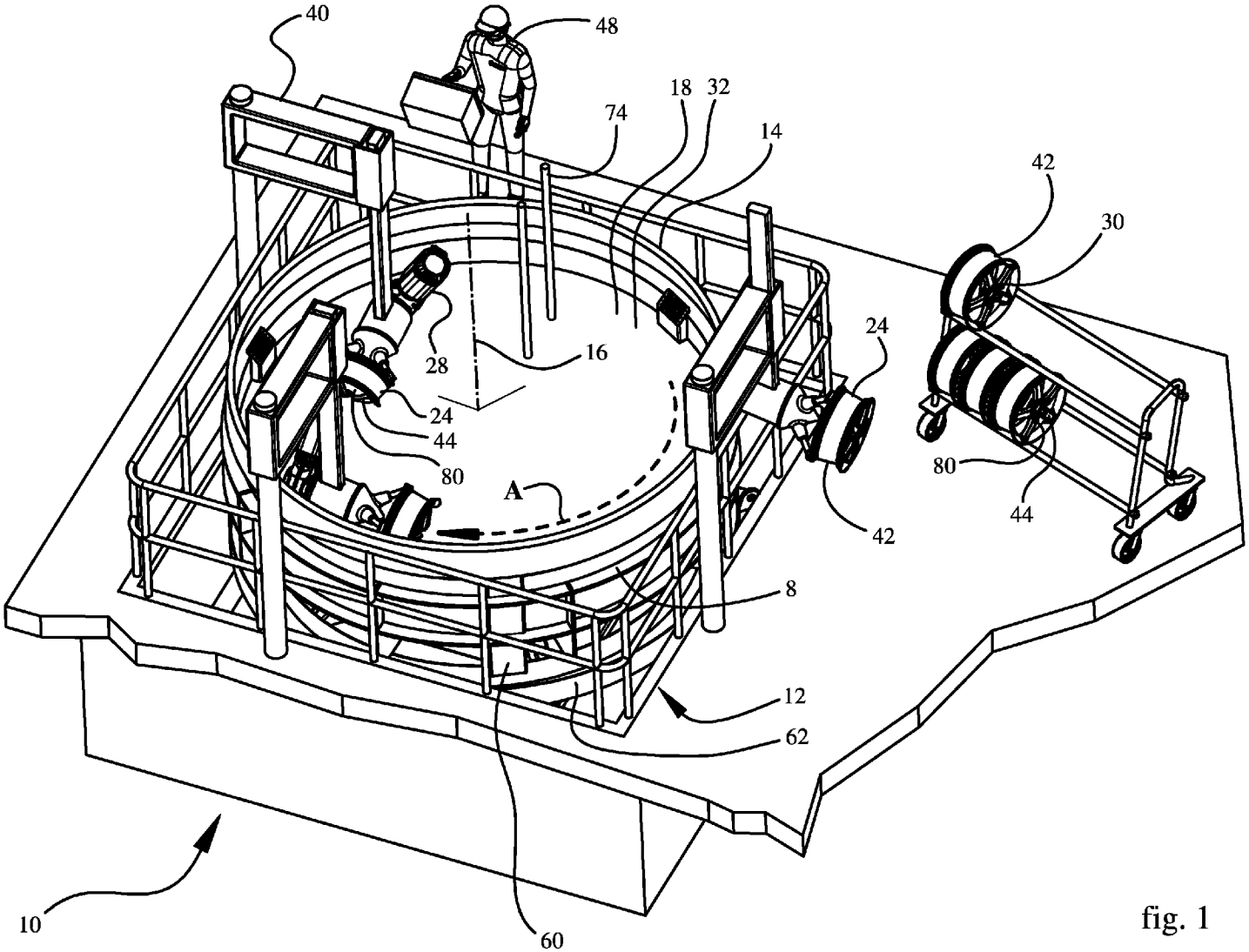
FIG. 1 is a perspective view illustration of a work station with a mass finishing apparatus having a tub rotatable about a vertical axis and a spindle supporting and rotating a workpiece about a spindle axis spaced apart from the vertical axis.
Figure 2:
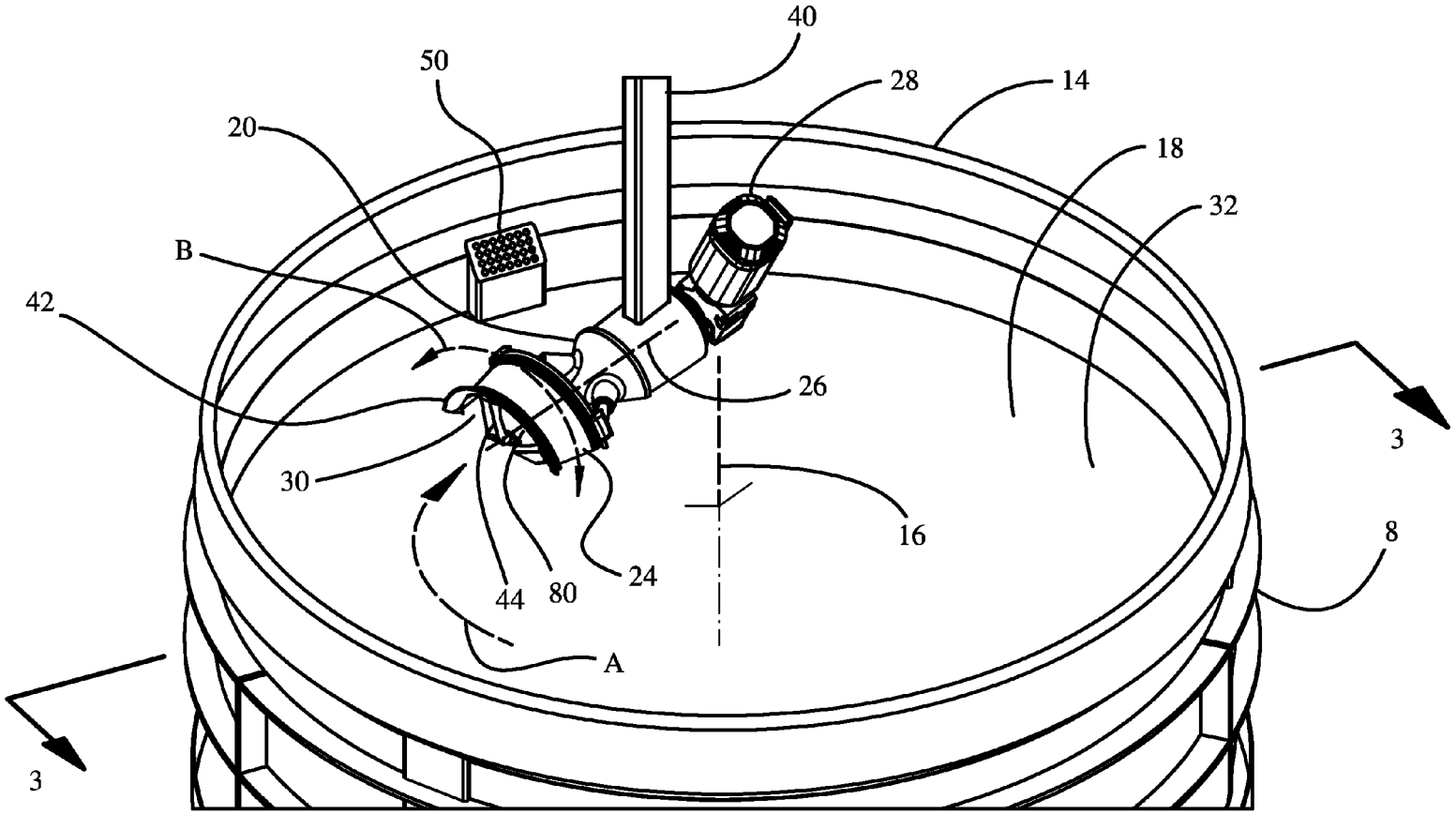
FIG. 2 is an enlarged perspective view of the tub, spindle, and workpiece illustrated in FIG. 1.

Illustrated schematically in FIGS. 1 and 2 is a work station 10 with a mass finishing apparatus 12 for finishing workpieces 24. The mass finishing apparatus 12 is particularly useful for finishing multiple workpieces 24 simultaneously and continuously. The exemplary embodiment of the mass finishing apparatus 12 processes or finishes multiple workpieces 24 simultaneously and workpieces 24 can be loaded and unloaded from apparatus while the apparatus continuously processes workpieces not being loaded or unloaded.

The exemplary embodiment of the mass finishing apparatus 12 illustrated herein includes a frame 8 rotatably supports a tub 14 which is rotatable about a vertical axis of rotation 16. The tub 14 is filled with abrasive media 18 and the abrasive media 18 is completely submerged in water 32 or another liquid. The media 18 and the water 32 are completely mixed. The level of water 32 is kept to about 1-2 inches above the abrasive media 18 in the exemplary embodiment of the mass finishing apparatus 12 and method disclosed herein. By having the abrasive media 18 completely submerged in water 32 or another liquid the damming-up, the balling-up, the resulting loss of cut on the workpieces 24, and the resulting inefficiency of the process, is greatly reduced or eliminated. A tub motor (not shown) is typically used to rotate the tub 14 at a tub rotational speed A about the vertical axis of rotation 16.

Manipulators 40 hold and positions the workpieces 24 at least partially submerged in the media 18 in the tub 14 as the tub rotates. Each manipulator 40 supports, moves, positions, and enables a spindle 20 used for supporting and rotating a workpiece 24 at least partially and, preferably, mostly submerged in the media 18 in the tub 14 as the tub rotates. If the workpiece 24 is running too shallow or not sufficiently submerged poor results may be are obtained. If the workpiece is running too deep or too much submerged, a spindle motor 28 or drive rotating the workpiece may be loaded beyond its capability and in the case of an electric motor may trip out the motor. The workpieces may be substantially completely submerged, completely submerged, or partially submerged in the media 18.

The spindle 20 and the workpiece 24 it is holding are rotated about a spindle axis 26 at a spindle rotational speed B. The manipulator 40 positions the spindle 20 and its spindle axis 26 substantially horizontally in the media 18 and normal to and spaced apart from the vertical axis 16 during the mass finishing process while the tub 14 is rotating. The spindle motor 28 mounted on the manipulator 40 is operably connected to and effect rotation of the spindle 20 about the spindle axis 26. The exemplary motor used to rotate the tub and the exemplary spindle motor 28 illustrated herein are electric motors. Other drives or means of rotating the spindle may be used. One or more manipulators 40 may be used and though three manipulators are illustrated herein, more can be incorporated in work station 10.

The manipulators 40 illustrated herein are operable to submerge and retract the workpieces 24 in the media 18 in the tub 14 as the tub continuously rotates. The manipulators 40 illustrated herein are operable to present the workpieces 24 to an operator 48 for loading and unloading the workpieces 24 on and off the spindles 20 on the manipulators 40. Each of the manipulators 40 illustrated herein is independently capable to present one of the workpieces 24, while the tub 14 is rotating and continuing to process the other workpieces 24 that continue to be submerged in the media 18 and water 32.

The exemplary workpieces 24 illustrated herein are cast aluminum car wheels 42 that are prepped for a subsequent chrome plating process. The rotating tub 14 causes the media 18 to rotate about the vertical axis 16 while the mostly submerged workpieces 24 are rotated about their spindle axes 26 causing water and media water through an opening 30 in the workpiece 24. This causes the water 32 and media 18 to flow through the opening 30 in the workpiece 24 which provides a hydrodynamic action of the media and water upon the surface of the workpiece and improves finishing of the surface. The exemplary wheels 42 illustrated herein have openings 30 between spokes 44 of the wheels.

Figure 3:
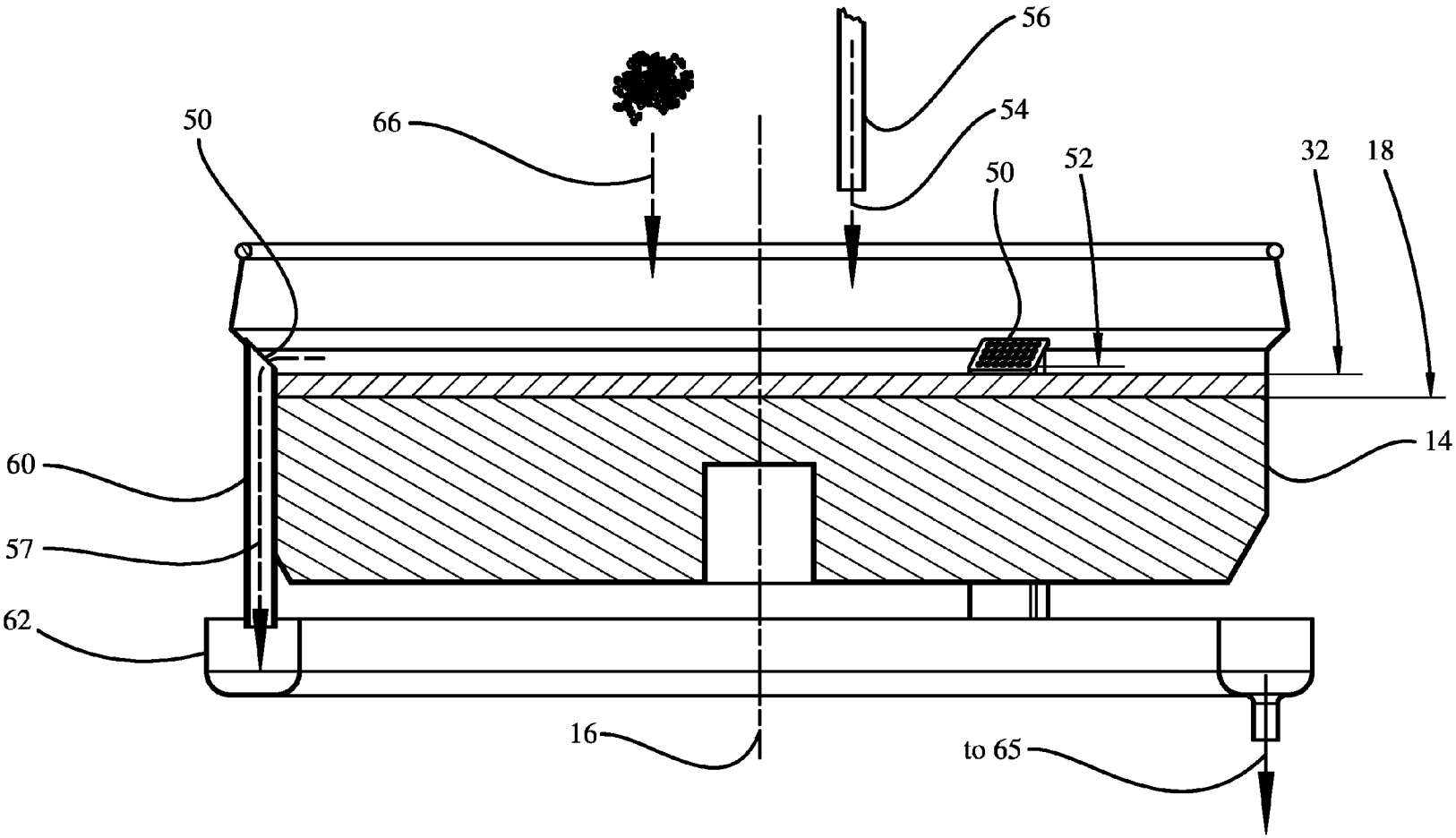
FIG. 3 is a cross-sectional view of the tub through 3-3 in FIG. 2.

Screened drains 50 are located at and define a high water mark 52 in the tub 14 as illustrated in FIGS. 2 and 3. Replacement water 54, also referred to as feed water, is supplied to the tub 14 by a feed water line such as an overhead water supply pipe 56 illustrated in FIG. 3. Spent media resulting from media wear during processing goes into suspension in water 32 to form spent media mixture 57. During processing, media 18 and spent media mixture 57 are constantly stirred and mixed. Replacement water continues to be introduced, raising the level of the spent media mixture 57 to the level of the drains 50. Media 18 is heavier than water and stays behind in tub 14. One exemplary water replacement rate is about 20 gallons per minute (GPM) for the mass finishing apparatus 12 illustrated herein. In terms of mass, 20 GPM is approximately 10,000 pounds of water per hour.

The spent media mixture 57 is drained off as overflow at the drains 50 and carried via down tubes 60 that are attached to and rotate with the tub 14. The spent media mixture 57 drained off through the tubes 60, dumps into a stationary collection channel 62, and is then pumped over to a precipitation water treatment plant 65. Design flow for the replacement water 54 is such that the spent media constitutes less than 0.5% of the media mixture 57 by mass, including the quantity of metal that is also carried out.

For the exemplary mass finishing apparatus 12 illustrated herein the media 18 consumption is approximately 48 pounds per hour. The mass of the waste stream thus must be 10,000 pound per hour to maintain the 0.5% design parameter. This is equivalent to a replacement water 54 flow of approximately 20 gallons per minute. Media feed 66 replaces the lost media at about 48 pounds per hour in exemplary embodiment illustrated herein. The media feed may be done by automatically by machine or manually.

Figure 4:
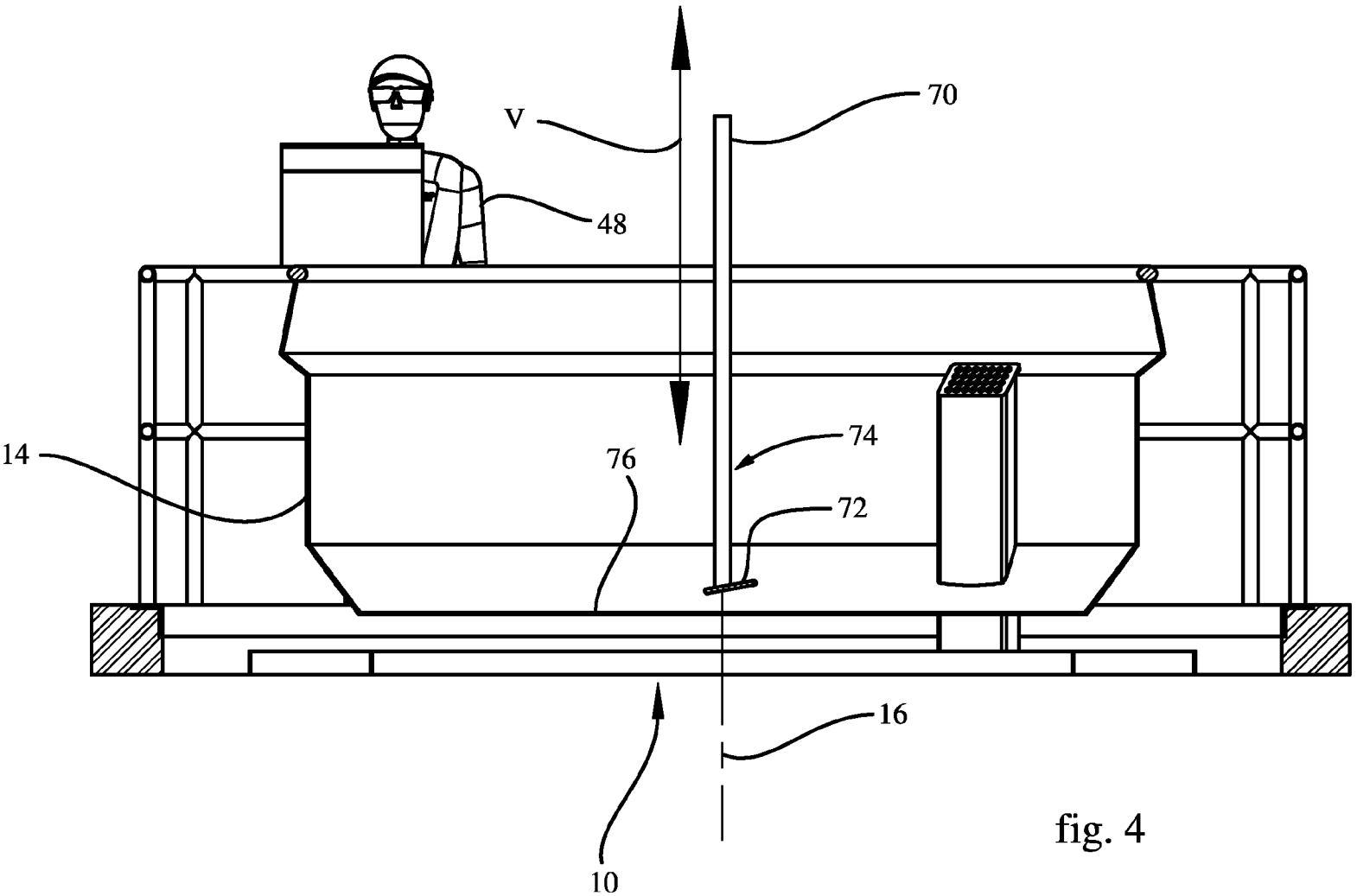
FIG. 4 is a partially cutaway perspective view of a tub and its support frame illustrated in FIG. 1.

The mass finishing apparatus 12 illustrated herein has a rake 70 as illustrated in FIG. 1. The rake 70 is illustrated in more detail in FIG. 4 as including a pitched plate 72 mounted to rounded slide poles 74 extending and operable to lift the pitched plate 72 up and down vertically V and parallel to the vertical axis 16 during a raking cycle of the method. The raking cycle includes the pitched plate 72 being lowered into the tub 14 at a vertical speed that is synchronized to the tub rotational speed A of the tub 14 so that the pitched plate 72 makes a helix upon entry. The rake 70 is controlled so that the pitched plate 72 stops just shy of a bottom 76 of the tub 14 and then it is slowly raised. During the raising and the upward movement of the plate, the smaller pieces of media that collect in the lower part of the tub 14 are carried upwardly. The raking provides rolling and mixing of effectively the entire volume of media which counters stratification. The raking cycles are run periodically or may be controlled by the operator or an automated controller.

Draining of the spent media mixture 57 as overflow through the drains 50, replacing water drained with feed water or replacement water, and rolling and mixing of substantially the entire volume of media, for example by raking, enhances the efficiency of the process and helps provide for the process to be continuous. The apparatus 12 supplies tub power for rotating the tub 14 and workpiece power, the power used to rotate a single workpiece, for rotating each one of the one or more spindles 20 during the surface finishing process.

An exemplary finishing process using the mass finishing apparatus 12 disclosed herein includes spinning the tub 14 and media 18 so that the tangential velocity of the media is between to 70-100 feet per minute at a open front 80 of the workpiece 24. The tub 14 and media 18 is continuously spinning as multiple workpieces 24 are finished at each of three manipulator 40. Each workpiece is substantially submerged in the rotating media 18 for about 12 minutes for the finishing. A constant flow of water and media 18 passes through the openings 30 in the workpiece 24. The power required to rotate the tub 14 and media 18 for this exemplary process is reduced and power to process each workpiece 24 about the vertical axis 16 is about 2 HP per workpiece 24 or 6 HP for all three workpieces 24.

Another exemplary finishing process using the mass finishing apparatus 12 disclosed herein includes spinning the workpiece 24 about the spindle axis 26 in a range of about 125 to 175 RPM resulting in a tangential velocity of between to 600-800 feet per minute at a open front 80 of the workpiece 24. The tub 14 and media 18 is continuously spinning as multiple workpieces 24 are finished, one at each of three manipulator 40. The power required to rotate each of the three workpieces 24 about the spindle axes 26 is about 8-10 HP per workpiece 24. This is a total of about 35 HP. Thus, the ratio of tub power, power used to the rotate the tub 14, to workpiece power, power used to rotate each one of the workpieces 24, is about 1:6.

The efficiency of the mass finishing apparatus 12 is enhanced by providing the apparatus and method of using the apparatus with a ratio of tub power to workpiece power, the power used to rotate a single workpiece, significantly less than 1:1. The exemplary embodiment of the mass finishing and method of using the apparatus illustrated herein has ratio of tub power to workpiece power in a range of 1:2-1:8. This lets the tub motors use significantly less electricity to rotate the tub loaded with water and media while letting the motors that rotate the workpieces use more but they rotate much less mass and so the net total usage of electricity or power is less.

Some commercially available finishing machines use a single 30 HP electric motor to drive the tub and a single 5 HP drive to rotate three workpieces. The total power required is about the same but the cycle time for the finishing system and method disclosed herein is much less and thus uses less electricity and is significantly less expensive. It is estimated that the present invention may provide a savings of about 50% in cycle time and power consumption.

While the preferred embodiment of the invention has been described fully in order to explain its principles, it is understood that various modifications or alterations may be made to the preferred embodiment without departing from the scope of the invention as set forth in the appended claims.

We claim:

1. A finishing apparatus for surface finishing one or more workpieces, the apparatus comprising:

a tub rotatable about a vertical axis, the tub operable to hold and rotate abrasive media, one or more manipulators, each of the manipulators supporting a spindle operable for supporting and rotating a workpiece about a spindle axis of the spindle with the workpiece at least partially submerged in the abrasive media, each of the manipulators operable for holding the spindle in the tub during the surface finishing process while the tub is rotating, and one or more drains located at a position in the tub above the abrasive media.

2. The apparatus of claim 1, further comprising a rake including a plate and means for lifting the plate up and down vertically through the abrasive media and parallel to the vertical axis.

3. The apparatus of claim 1, wherein the abrasive media is completely submerged in water or other liquid.

4. The apparatus of claim 1, further comprising down tubes extending from the drains downward to a stationary collection channel.

5. The apparatus of claim 4, further comprising a rake including a plate and means for lifting the plate up and down vertically through the abrasive media and parallel to the vertical axis.

6. The apparatus of claim 1, further comprising each of the manipulators operable to present the workpieces for loading and unloading the workpieces on and off the spindle while the tub is rotating.

7. The apparatus of claim 6, further comprising a rake including a plate and means for lifting the plate up and down vertically through the abrasive media and parallel to the vertical axis.

8. The apparatus of claim 6, further comprising down tubes extending from the drains downward to a stationary collection channel.

9. The apparatus of claim 6, further comprising a feed water line or water supply pipe operable to supply replacement water to the tub during the surface finishing process while the tub is rotating.

10. The apparatus of claim 9, further comprising:

the apparatus operable for supplying tub power for rotating the tub during the surface finishing process, the apparatus operable for supplying workpiece power for rotating each one of the one or more spindles during the surface finishing process, and the apparatus operable for supplying the tub power and the workpiece power at a ratio of tub power to workpiece power significantly less than 1:1.

11. The apparatus of claim 10, further comprising the ratio of tub power to individual workpiece power being in a range of 1:2-1:8.

12. The apparatus of claim 1, wherein the one or more manipulators comprises two or more manipulators, each of the manipulators operable to present the workpieces for loading and unloading the workpieces on and off the spindle while the tub is rotating, and each of the manipulators is independently operable to present one of the workpieces for loading and unloading on and off the spindle while the tub is rotating and continuing to process the other workpieces submerged in the abrasive media.

13. The apparatus of claim 12, further comprising a rake including a plate and means for lifting the plate up and down vertically through the abrasive media and parallel to the vertical axis.

14. The apparatus of claim 13, further comprising a feed water line or water supply pipe operable to supply replacement water to the tub during the surface finishing process while the tub is rotating.

15. The apparatus of claim 14, further comprising:

the apparatus operable for supplying tub power for rotating the tub during the surface finishing process, the apparatus operable for supplying workpiece power for rotating each one of the one or more spindles during the surface finishing process, and the apparatus operable for supplying the tub power and the workpiece power at a ratio of tub power to workpiece power significantly less than 1:1.

16. The apparatus of claim 15, further comprising the ratio of tub power to workpiece power being in a range of 1:2-1:8.

17. A method for finishing one or more workpieces, the method comprising:

rotating a tub containing abrasive media about a vertical axis;

at least partially submerging one or more workpieces in the abrasive media, wherein each of the one or more workpieces is mounted to each of one or more spindles;

rotating each of the one or more the spindles about a spindle axis to thereby rotate the workpiece mounted thereto about the spindle axis while the tub is rotating, sequentially processing or finishing a plurality of the one or more workpieces by loading, finishing in the media in the tub, and then unloading each one of the plurality of workpieces while other of the plurality of workpieces are being finished in the tub, wherein a tub power supplied to the tub for rotating the tub and a workpiece power supplied to each of the one or more spindles for rotating each of the one or more spindles are at a tub power to workpiece power ratio of less than 1:1.

18. The method of claim 17, further comprising rolling and mixing the abrasive media in the tub during the surface finishing while the tub is rotating.

19. The method of claim 18, further comprising the rolling and mixing including lifting a plate of a rake up and down vertically through the abrasive media and parallel to the vertical axis while the tub is rotating and the one or more workpieces are rotating about the spindle axes of the corresponding spindles at least partially submerged in the abrasive media.

20. The method of claim 18, further comprising:

supplying the tub power to the tub for rotating the tub during the finishing, and supplying the workpiece power to each of the one or more spindles for rotating the one or more spindles during the finishing.

21. The method of claim 17, further comprising the ratio of tub power to workpiece power being in a range of 1:2-1:8.

22. The method of claim 17, wherein the abrasive media is completely submerged in water or other liquid.

23. The method of claim 22, further comprising:

draining spent media mixture through one or more drains located at a position in the tub above the media, the spent media mixture including spent media resulting from media wear during the finishing, and replacing the spent media in the drained away spent media mixture.

24. The method of claim 23, further comprising rolling and mixing the abrasive media in the tub during the surface finishing while the tub is rotating.

25. The method of claim 24, further comprising the rolling and mixing includes lifting a plate of a rake up and down vertically through the abrasive media and parallel to the vertical axis while the tub is rotating and the one or more workpieces are rotating about the spindle axes of the corresponding spindles at least partially submerged in the abrasive media.

26. A finishing apparatus, comprising:

a tub rotatable about a vertical axis, the tub operable to hold abrasive media;

a manipulator that supports a spindle, the spindle configured to support a workpiece when the workpiece is loaded onto the spindle, wherein the manipulator is operable to hold the spindle in the tub while the tub is rotating to thereby at least partially submerge a supported workpiece in the abrasive media while the tub is rotating, the spindle is operable for rotating the supported workpiece about a spindle axis of the spindle when the supported workpiece is at least partially submerged in the abrasive media, and the manipulator is operable to present the spindle for loading a respective workpiece on the spindle and unloading the respective workpiece from the spindle while the tub is rotating.

27. The apparatus of claim 26, wherein the manipulator is a first manipulator, the spindle is a first spindle, and the apparatus further comprises:

a second manipulator that supports a second spindle, the second spindle configured to support a workpiece when the workpiece is loaded onto the second spindle, wherein the second manipulator is operable to present the second spindle for loading a second respective workpiece on the second spindle and unload the second respective workpiece from the second spindle while the first manipulator holds the first spindle in the tub while the tub is rotating to thereby continue processing the respective workpiece loaded on the first spindle.

28. The apparatus of claim 27, wherein the second manipulator is operable to hold the second spindle in the tub while the tub is rotating to thereby at least partially submerge a supported workpiece in the abrasive media while the tub is rotating, and the first manipulator is operable to present the first spindle for loading the respective workpiece on the first spindle and unloading the respective workpiece from the first spindle while the second manipulator holds the second spindle in the tube while the tub is rotating to thereby continue processing the respective workpiece loaded on the second spindle.

29. The apparatus of claim 26, wherein a tub power supplied to the tub for rotating the tub and a workpiece power supplied to the spindle for rotating the spindle are at a tub power to workpiece power ratio less than 1:1.

30. A finishing apparatus comprising:

a tub rotatable about a vertical axis, the tub operable to hold abrasive media;

a rake including a plate and means for lifting the plate up and down vertically through the abrasive media;

a manipulator that supports a spindle, the spindle configured to support a workpiece when the workpiece is loaded onto the spindle, wherein the manipulator is operable to hold the spindle in the tub while the tub is rotating to thereby at least partially submerge a supported workpiece in the abrasive media while the tub is rotating, and the spindle is operable for rotating the supported workpiece about a spindle axis of the spindle when the supported workpiece is at least partially submerged in the abrasive media.

31. The apparatus of claim 30, further comprising:

a drain located at a position in the tub above the abrasive media.

32. The apparatus of claim 30, wherein a tub power supplied to the tub for rotating the tub and a workpiece power supplied to the spindle for rotating the spindle are at a tub power to workpiece power ratio less than 1:1.

* * * * *